United States Patent [19]

James et al.

[11] Patent Number: 4,538,038

[45] Date of Patent: Aug. 27, 1985

[54] DOOR PANEL POSITION SENSOR ASSEMBLY

[75] Inventors: Benjamin B. James, Birchrunville; Edward Peel, Havertown, both of Pa.

[73] Assignee: Westcode, Inc., Frazer, Pa.

[21] Appl. No.: 550,084

[22] Filed: Nov. 9, 1983

[51] Int. Cl.[3] ..... H01H 3/16

[52] U.S. Cl. ..... 200/61.71; 200/61.62; 200/47; 200/153 V; 200/329

[58] Field of Search ..... 200/153 T, 153 V, 61.71, 200/61.72, 61.73, 61.74, 61.75, 47, 329, 61.62

[56] References Cited

U.S. PATENT DOCUMENTS

| | | | |
|---|---|---|---|
| 763,615 | 6/1904 | Laur | 200/47 |
| 3,272,936 | 9/1966 | Potter | 200/220 |
| 3,530,268 | 9/1970 | Aubrey | 200/47 |

*Primary Examiner*—John W. Shepperd
*Attorney, Agent, or Firm*—Larson & Taylor

[57] ABSTRACT

A door panel position sensor assembly for a transit vehicle is provided which comprises a door mounted actuator device and a vehicle mounted switch operating mechanism which is mounted adjacent to the path of travel of the door and is actuated by the door-mounted actuator device during movement of the door between open and closed positions. The switch operating mechanism comprises a signalling switch whose switching state indicates the position of the door and a single actuator lever which is movable by the door mounted actuator device between first and second positions to control actuation and de-actuation of the switch. A spring arrangement is located between actuator arm and the signalling switch which assists in toggling of the actuator lever and which, under the control of the actuator lever, engages the switch to provide actuation thereof. The door-mounted actuator device includes a first, rigid actuator and a second, directionally flexible actuator which is spaced apart from the first actuator in the direction of travel of the door and which prevents damage to the switch operating mechanism when the latter is reset, due to inadvertence or vandalism, to the non-normal position thereof prior to a closing movement of the door. In particular, the directionally flexible actuator enables that actuator to bypass the actuating lever of the switch operating mechanism without damage to the switch operating mechanism during a closing movement of the door, while permitting the flexible actuator to serve its normal function as an actuator for opening movements of the door.

18 Claims, 7 Drawing Figures

DOOR PANEL POSITION SENSOR ASSEMBLY

FIELD OF THE INVENTION

The present invention relates to a door panel position sensor assembly for a rapid transit vehicle for sensing or monitoring the position of a vehicle door and for indicating whether the door is open or closed.

BACKGROUND OF THE INVENTION

Rapid transit vehicles which provide mass transportion of passengers characteristically include a door operator for driving a door or door panel between open and closed positions, as well as sensors or monitors for sensing the position of the door. For example, U.S. Pat. No. 3,537,403 (Daugirdas et al) discloses a door position sensor for sensing whether a door is in the open or closed position and for controlling actuation of a switch in an interlock traction motor circuit so as to prevent operation of the traction motor for the transit vehicle when the door is still open. Such door position sensors can take a number of different forms and two different embodiments of door position sensors are disclosed in U.S. Pat. No. 3,857,197 (Reddy et al). One of these embodiments, and a particular problem associated therewith, is discussed in some detail below and this discussion will not be repeated here. However, in brief, the problem referred to involves the vulnerability of the operating mechanism of the door panel sensor to damage or destruction when, due to poor maintenance, vandalism or the like, the mechanism is set to the non-normal position thereof so that the mechanism is exposed to being damaged by the door mounted actuator when the door is closed. Further, the door panel position sensors of the prior art suffer additional disadvantages with regard to ease of adjustability to compensate for changes due to wear as well as with respect to simplicity of manufacture and maintenance.

SUMMARY OF THE INVENTION

In accordance with the invention, an improved door or door panel position sensor assembly is provided which produces an accurate and reliable indication of the door position, which permits the door to be forced open a predetermined limited amount without signalling that the door is open (and thereby preventing a false indication that the door is open under these circumstances), and which, at the same time, overcomes the problems discussed above. The door position sensor assembly of the invention is simple and relatively inexpensive in construction, easy to maintain and readily adjustable to compensate for wear.

According to a preferred embodiment thereof, the door panel position sensor assembly of the invention comprises a door mounted actuator device and a vehicle mounted switch operating mechanism which is actuated by the door-mounted actuator device and which includes a signalling switch whose switching state indicates the position of the door. The switch operating mechanism comprises a single actuator lever or arm which is movable by the door mounted actuator device between first and second positions to control actuation and de-actuation of the switch. Preferably, a spring arrangement is located between actuator arm and the signalling switch which assists in toggling of the actuator lever and which engages the switch to provide actuation thereof.

In accordance with an important feature of the invention, the door-mounted actuator device includes a first, rigid actuator and a second, directionally flexible actuator spaced apart from each other in the direction of travel of the door. As explained in more detail below, this arrangement enables limiting opening movement of the door without actuating the signalling switch and at the same time, prevent damage to the switch operating mechanism when the latter is reset, due to inadvertence or vandalism, to the non-normal position thereof prior to a closing movement of the door. While this feature can be best understood from the detailed description thereof which follows, generally speaking, the provision of a directionally flexible actuator enables that actuator to bypass the actuating lever of the switch operating mechanism without damage to the switch operating mechanism during a closing movement of the door, while permitting the flexible actuator to serve its normal function as an actuator for opening movements of the door.

The fixed and directionally flexible actuators are formed as part of an actuator base plate or bracket which is secured by bolts or the like to the door edge of the door. Similarly, the switch actuator lever, spring arrangement and signalling switch are preferably mounted on a further base plate or bracket secured by bolts or the like to the vehicle proper. With this arrangement, adjustment of the positions of the two base plates can be readily effected to compensate for wear.

The spring arrangement referred to above preferably comprises a two-part spring carrier or guide which supports a biassing spring. Advantageously, the two parts are identical and are made of plastic so that construction of the spring guide is simple and inexpensive.

Other features and advantages of the present invention will be set forth in, or apparent from, the detailed description of the preferred embodiments of the invention found hereinbelow.

DESCRIPTION OF THE PREFERRED EMBODIMENTS

Figure 1:
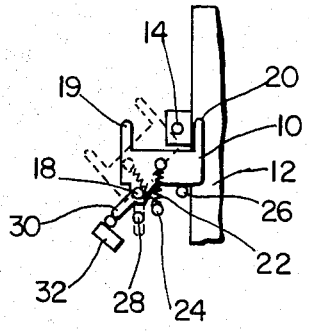
PRIOR ART FIG. 1
FIGS. 1 and 2 are side elevational views of a prior art door position sensor, illustrating different stages in the operation thereof.
Figure 2:
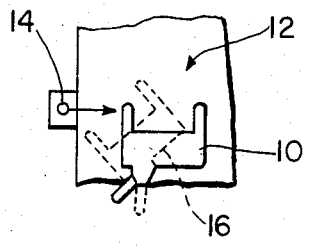
PRIOR ART FIG. 2

Referring to FIGS. 1 and 2, a prior art door position sensor is shown which is of the type disclosed in U.S. Pat. No. 3,857,197 (Reddy et al). The door position sensor is generally denoted 10 while the door whose movement is to be sensed is denoted 12. The latter includes a door pin 14 which is affixed to the trailing edge thereof and which extends outwardly from the plane of the drawing.

Sensor 10 includes a generally U-shaped plate 16 which is pivotably mounted on a shaft 18 for movement between the solid and dashed line positions shown in FIG. 1. A pair of spaced, upwardly extending arms 19 and 20 receive pin 14 therebetween. A spring 22 is attached at one end to plate 16 and at the other to a fixed pin 24 such that the spring 22 is in overcenter relationship with respect to shaft 18 when the plate 16 is in the "door closed" position thereof shown in solid lines and when the plate 16 is in the "door open" position thereof shown in dashed lines. Thus, spring 22 is toggled to snap into one of two positions and, accordingly, maintains plate 16 in either one of two positions, viz., against a stop pin 26 or against a stop pin 28.

Plate 16 includes a cam arm 30 which, with plate 16 in the "door closed" position against stop pin 26, engages a limit switch 32. Thus, when door 10 moves to the open position thereof, i.e., to the left in FIG. 1, door pin 14 strikes and engages arm 19 of plate 16 to drive plate 16 to the door closed position shown in dashed lines, and cam arm 30 pivots away from switch 32. Similarly, when door 10 moves to closed position thereof, i.e., to the right in FIG. 1, door pin 14 strikes and engages arm 20 of plate 16 to drive the plate to the door closed position shown in solid lines and to thereby actuate switch 32. Switch 32 is connected in series in the traction motor interlock circuit so that when switch 32 is actuated indicating that the door is closed, the traction motor (not shown) can be actuated, assuming all other conditions are met. The spacing between arms 19 and 20 provides a "lost motion" mode of operation wherein once the door 10 has been moved to the closed position and thus has caused pivoting of plate 16 to the "door closed" position, the door can be moved a limited distance in the opposite direction toward the open position before engaging arm 19 and thus de-actuating switch 32.

Referring to FIG. 2, a further, unintended mode of operation of the door position sensor of FIG. 1 is illustrated. As set forth above, with door 10 in the open position thereof, plate 16 will be driven into the pivoted position thereof shown in dashed lines and will normally remain in this position until the door is closed. However, if, due to inadvertence or vandalism, plate 16 is pivoted to the solid line position thereof, which would normally be the "door closed" position thereof, pin 14 will strike arm 19 (rather than arm 20) when the door 10 is moved to closed position. Plate 16 is held against stop 26 under these conditions and thus it will be appreciated that this unintended mode of operation can result in considerable damage to or total destruction of the door sensor operating mechanism.

Figures 3, 5:
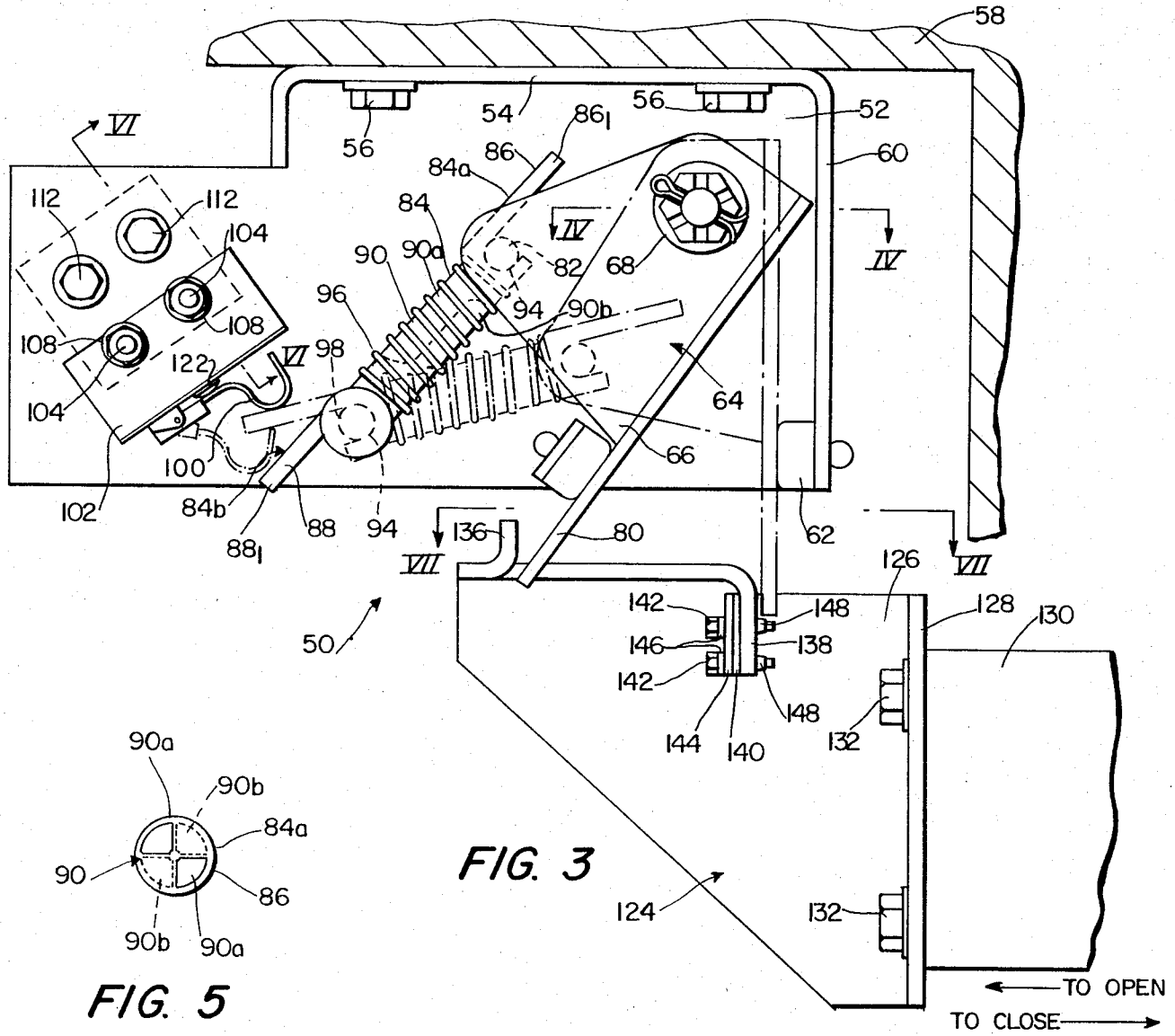
FIG. 3 is a top or plan view of the door panel position sensor of the invention.
FIG. 5 is an end view of a part of the spring guide of the door panel position sensor of FIG. 3.

Referring to FIG. 3, a preferred embodiment of the door panel sensor assembly of the invention is shown. The assembly, which is generally denoted 50, includes a support bracket or base plate 52 which serves as an open housing for the operating mechanism. An upstanding sidewall flange 54 of base plate 52 is bolted by means of a pair of bolts 56 to the transit car structure, which is generally denoted 58, so that assembly 50 is fixedly mounted on the car. An integral upstanding rearwall flange 60 mounts a bumper or stop member 62 whose function will be evident from the description which follows.

Figure 4:
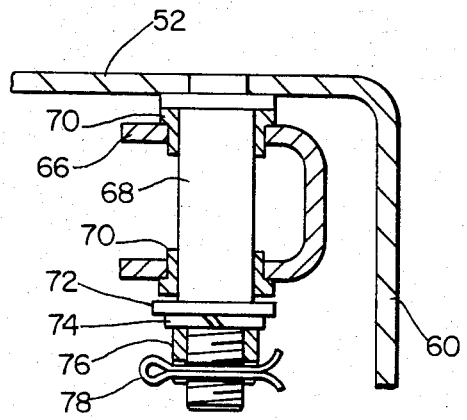
FIG. 4 is a cross sectional view taken generally along line IV—IV of FIG. 3.

A switch actuator lever assembly 64 is mounted on base plate 52 by means of a mounting arrangement best seen in FIG. 4, the latter a section taken generally along line IV—IV of FIG. 3. The assembly 64 includes a switch actuator lever or actuator arm 66 which is of U-shaped construction in cross section and is mounted for rotation about a shaft or spindle 68 affixed to base plate 52. The mounting assembly includes a pair of busings 70, a flat washer 72, a split lock washer 74, a slotted hex nut 76 and a cotter pin 78, which cooperate to fix lever 66 in place on shaft 68. As shown in FIG. 3, switch actuator lever 66 includes a central tongue 80 which, as will appear, serves as an actuator arm.

As shown in FIG. 3, a pin 82 is supported by and extends between the walls of actuator lever 66 and serves as a pivot support for one end of a spring guide or spring carrier 84. Spring carrier 84 which serves, inter alia, as a switch actuator member includes spring abutment end portions 86 and 88 at opposite ends thereof and a central cylindrical body portion 90. Generally U-shaped grooves 92 and 94 are formed in end portions 86 and 88, respectively, and pin 82 is received in groove 92. A cylindrical coil spring 96 surrounds cylindrical body portion 90 and biases end portion 86 into engagement with pin 82 and biases end portion 88 into engagement with an upstanding pin member 98 which is affixed to support plate 52 and is received in groove 94. Thus, spring carrier 84 is adapted to pivot about pivot pin 98 under the control of, and in response to pivoting of, switch actuator lever 64.

Spring carrier 84 is advantageously made in two parts, denoted **84*a* and 84*b*, which fit together to form the complete device. More specifically each part 84*a*, 84*b* includes one end portion and part of the body portion 90, and these latter parts are shaped and arranged so as to slidably fit together to form a complete cylinder. In particular, as shown in FIG. 5 for part 84*a*, two oppositely disposed, elongate "quadrants" of the composite cylinder body 90 are provided on each part. These quadrants are denoted 90*a* in FIG. 5 and extend longitudinally outwardly from the corresponding end portion so that when the parts 84*a*, 84*b* are fit together these quadrants 90*a* cooperate with corresponding quadrants 90*b* of part 84*b* (indicated in dashed lines in FIG. 5) to form the complete composite cylinder 90. It will be understood that with this arrangement, parts 84*a*, 84*b*, which are fabricated of plastic, can be made as identical parts (note the identical offset from the vertical of each part), thus greatly facilitating manufacture of the spring carrier 84**.

Figure 6:
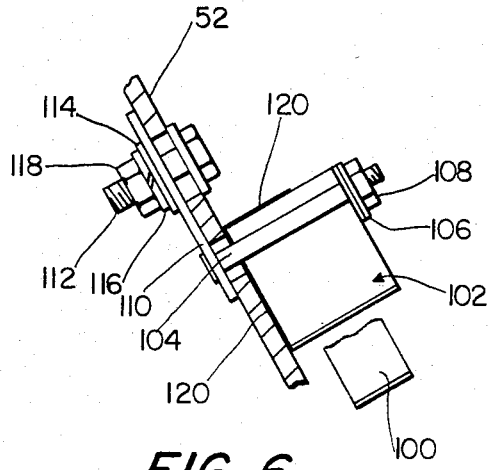
FIG. 6 is a cross section view taken generally along line VI—VI of FIG. 3.

End portions 86 and 88 of spring carrier 84 each include elongate longitudinally extending projections $86_1$ and $88_1$, the latter being adapted to engage the spring contact 100 of a lever switch 102. Switch 102 is mounted on base plate 52 by means of a mounting arrangement shown in FIG. 6. This mounting arrangement includes a pair of mounting screws 104, corresponding flat washers 106 and hex nuts 108, a switch mounting bracket 110, and a pair of hex head screws 112 for, in cooperation with associated flat washers 114, split lock washers 116 and locking hex nuts 118, affixing the mounting bracket 110 to the base plate 52. An insulator 120 insulates the switch body 102 from base plate 52. With spring carrier 84 in the position shown in dashed lines in FIG. 3, the elongate projection $88_1$ of the end portion 88 thereof forces spring switch 100 into engagement with switch button or contact 122 and thereby causes actuation of switch 102. With spring carrier 84 in the position shown in solid lines, spring 100 falls away from contact 122 and switch 102 is de-actuated.

Figure 7:
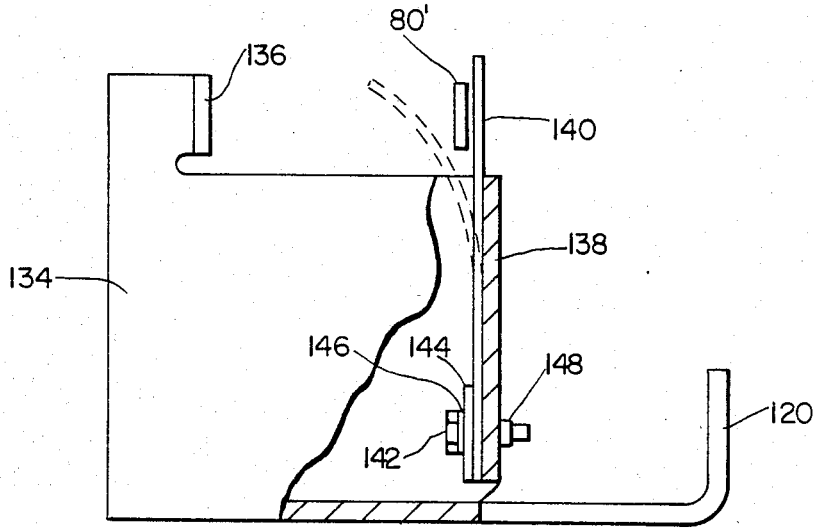
FIG. 7 is a side elevational view of the door-mounted actuator portion of the sensor, taken generally in the direction of line VII—VII of FIG. 3.

Pivoting of switch actuator lever 64 is controlled by a door mounted actuator assembly generally denoted 124. Assembly 124 includes a generally triangular support plate or bracket 126 including an upstanding flange 128 along one side thereof which is secured to trailing edge of the car door, denoted 130, by bolts 132. A further upstanding flange 134 extends partially along the side of support plate 126 which faces spring actuator lever 64 and which is also shown in FIG. 7, the latter being a view taken generally in the direction of arrows VII in FIG. 3. Flange 134 includes a fixed upper actuator portion 136 in the form of a flange which extends perpendicularly thereto in a direction toward actuator 64 and which is adapted to engage tongue 80 of actuator lever 64. Flange 134 also includes an intermediate support position 138 in the form of a flange which extends perpendicularly thereto in a direction away from actuator lever 64. Support portion 138 serves as a mounting for a flexible actuator member 140 which extends upwardly into the path of tongue 80 of actuator lever 64. As illustrated in FIG. 7, wherein flange 134 is partially broken away to show actuator member 140, actuator member 140 is affixed at the lower end thereof to support portion 138 and the latter extends along a substantial length of actuator member 140. Thus, support flange 138 serves as a backing for actuator 140 which resists bending thereof in a direction towards support flange 138 while permitting bending thereof in a direction away from support portion 138 (as indicted in dashed lines in FIG. 7) and thus actuator 140 is directionally flexible. The mounting assembly for actuator member 140 includes a pair of hex head screws 142 and a support plate 144, together with lock washers 146 and inserts 148.

Considering the normal operation of the actuator assembly 50 and assuming that the door 130 is open, when the door 130 is moved in a direction to provide closing thereof, i.e., towards the right as viewed in FIG. 3, actuator lever 64 is normally in the rest position thereof illustrated in solid lines in FIG. 3 and thus, switch 102. Under these conditions, tongue member 80 of actuator lever 64 is out of the path of flexible actuator member 140 and the latter will simply pass thereby. However, tongue 80 will subsequently be engaged by fixed actuator 136 during this closing movement so as to provide pivoting of lever 64 to the active position thereof wherein switch 102 is actuated by the toggling action of spring guide 84. The door 130 will then reach the limit position thereof and stop.

At this time tongue 80 of actuator lever 64 will be positioned between flexible actuator 140 (as indicated at 80′ in FIG. 7) and fixed actuator 136 and limited movement thereof in the opening direction, i.e., to the left as viewed in FIG. 3, is permitted without causing de-actuation of switch 102. This prevents false signalling when the car door 130 is forced open a predetermined limited amount, e.g., three inches, corresponding to the spacing between actuators 140 and 136, and the actuator lever tongue 80 "snap" travel.

Further movement of the door 130 in the "opening" direction will cause directionally flexible actuator 140 to engage tongue 80. As discussed above, "flexible" actuator 140 is flexible in one directin only and because of the backing provided by support portion 138 of flange 134, forms a rigid abutment when door 130 is moved in the opening direction. Thus, actuator 140 will cause pivoting of actuator lever 64 to the rest position thereof shown in solid lines and thus cause consequent de-actuating of switch 102.

An important feature of the invention concerns the provision for automatic self setting of the switch actuator mechanism 50 regardless of which position the actuation mechanism is left in when the door is in the open position. As discussed, during normal conditions, with the door open the actuator mechanism 50 is in the rest position thereof (shown in solid lines in FIG. 3), so that actuator 140 will simply pass thereby when moved to the closed position. However, there will be instances where, as described above for a prior art device in connection with FIGS. 1 and 2, due to poor maintenance, inadvertence or vandalism, the actuation mechanism 50 is reset to the active position thereof wherein tongue 80 extends into the path of actuator 140. With the arrangement of the present invention, the flexible nature of actuator 140 in the direction of closing movement permits actuator 140 to engage tongue 80 and to be flexed thereby and thus simply slip past tongue 80 which is held against stop or bumper 62. When flexible actuator 140 has passed thereby, tongue 80 is positioned between actuator 140 and actuator 136, i.e., in the normal position thereof, and thus the operating mechanism 50, rather than being damaged or destroyed as would be the case with prior art devices, is rather merely reset to the normal position thereof.

A further important feature of the invention concerns the easy adjustment of the positions of the components thereof. Such adjustment may be required because of wear with prolonged use so as to ensure safe and reliable operation. The necessary adjustments can be readily made by simply varying the postions of bolts 56 for mounting plate or bracket 52 and/or bolts 132 for mounting plate or bracket 124.

Although the invention has been described relative to an exemplary embodiment thereof, it will be understood by those skilled in the art that variations and modifications can be effected in this exemplary embodiment without departing from the scope and spirit of the invention.

We claim:

1. A door panel sensor assembly for a transit vehicle door which is movable longitudinally between an open position and a closed position, said assembly comprising:

a switch operating mechanism, mounted on the vehicle adjacent to the door, comprising a pivotable actuator arm pivotable between a first, active position and a second, inactive position, spring means for serving to assist pivoting of said actuator arm into one or the other of said two positions, and a control switch actuated by said spring means responsive to pivoting of said actuator arm to the active position thereof, and a door mounted actuator means, mounted on the trailing end of the door, for controlling pivoting of said actuator arm; said door mounted actuator means including a directionally flexible actuator which flexes for movement of the door in a first direction so as to permit the passage thereof by the pivotable actuator arm under circumstances where said actuator arm is positioned in the first position thereof in the path of travel of the directionally flexible actuator and which provides a rigid abutment for movement of the door in the opposite direction so as to cause pivoting of the pivotable actuator arm to the second position thereof when said actuator arm is postioned in the first position thereof in the path of travel of said directionally flexible actuator.

2. A door panel sensor assembly as claimed in claim 1 wherein said door mounted actuator means further comprises a second, rigid actuator spaced longitudinally from said directionally flexible actuator.

3. A door panel sensor assembly as claimed in claim 2 wherein said door mounted actuator means further comprises a support plate secured to the trailing edge of the door, said second actuator comprising a flange formed integrally with said support plate and said first actuator comprising a flexible actuator member secured at one end thereof to one side of a further flange formed integrally with said support plate.

4. A door panel sensor assembly as claimed in claim 1 wherein said pivotable arm, said spring means and said control switch are mounted on a common support plate secured to said vehicle adjacent to the door.

5. A door panel sensor assembly as claimed in claim 1 wherein said spring means comprises an elongate spring guide comprising first and second identical, axially moveable parts which slidingly fit together to form a composite body portion, and a spring mounted on said body portion in surrounding relation thereto, said spring guide including end portions which abut against the respective ends of said spring and which each include an end groove therein, said grooves respectively receiving therein a fixed pivot pin mounted on a support plate affixed to the vehicle and a further pivot pin mounted on said actuator arm.

6. A door panel sensor assembly as claimed in claim 5 wherein said actuator arm comprises a U-shaped member mounted for rotation about a fixed shaft secured to said support plate and including a central, outwardly extending tongue member, said further pivot pin being disposed between the side walls of said U-shaped member, and said support plate including stop means for limiting the amount of rotation of said actuator arm.

7. A door position sensor for a transit vehicle for indicating whether a vehicle door is in an open or closed position, said door being movable along a predetermined path of travel between the open and closed positions, and said door position sensor comprising:

switch means, mounted on the vehicle adjacent to the path of travel of the door, for indicating the position of the door, said switch means including a door position signalling switch and a single rotatable actuator lever, rotatable between a first position closely adjacent to the path of travel of the door and a second position adjacent to but further removed from the path of travel of the door, for controlling actuation and de-actuation of said door position signalling switch means; and door-mounted actuator means, mounted on the trailing edge of the vehicle door, for controlling rotation of said single actuator lever between said first and second positions, said door-mounted actuator means including a first rigid actuator and a second, directionally flexible actuator which is rigid for one direction of travel of the door and which is flexible for the opposite direction of travel of the door so as to permit passage thereof past said single actuator lever when the latter is in the first position thereof adjacent the path of travel of the door, said second actuator being spaced from said first actuator in the direction of travel of the door.

8. A door position sensor as claimed in claim 7 wherein said door position signalling switch and said rotatable actuator lever are both mounted on a common support plate secured to the vehicle adjacent to the path of travel of the door and said door-mounted actuator means comprises a further support plate secured to the trailing edge of the vehicle door, said first, rigid actuator comprising a flange formed integrally with said further support plate and said second, directionally flexible actuator comprising an elongate flexible member secured at one end thereof to one side of a further flange formed integrally with said further support plate.

9. A door position sensor as claimed in claim 7 wherein said switch means further comprises spring means, disposed between the actuator lever and the door position signalling switch, for causing actuation of said door position signalling switch responsive to rotation of said rotatable actuator lever to the first position thereof.

10. A door position sensor as claimed in claim 9 wherein said spring means comprises an elongate spring guide comprising first and second, identical, axially moveable parts which slidingly fit together to form a composite body portion, and a spring mounted on said body portion in surrounding relation thereto, said spring guide including end portions which abut against the respective ends of said spring and which each include an end groove therein, said grooves respectively receiving therein a fixed pivot pin mounted on a support plate affixed to the vehicle and a further pivot pin mounted on said actuator lever.

11. A door panel sensor assembly as claimed in claim 10 wherein said actuator arm comprises a U-shaped member mounted for rotation about a fixed shaft secured to said support plate and including a central, outwardly extending tongue member, said further pivot pin being disposed between the side walls of said U-shaped member, and said support plate including stop means for limiting the amount of rotation of said actuator arm.

12. A door position sensor assembly for sensing the position of the door of a transit vehicle and for indicating whether the door is in the open or closed position thereof, said door being movable along a predetermined path between the open and closed positions thereof and said door position sensor comprising:

a mounting bracket mounted on the trailing edge of the door and comprising first and second, longitudinally spaced actuator members spaced apart along said predetermined path, said second actuator member being located closest to the trailing edge of the door and comprising a directional flexible actuator which is rigid for one direction of travel of the and is flexible for the other direction of travel of the door; and a second mounting bracket mounted on the vehicle adjacent to the path of travel of the door, actuator means mounted on said second mounting bracket and including a single actuator arm pivotable between a first position in which the actuator is engageable by both of said actuator members and a second position in which the actuator is engageable by only said first actuator, said single actuator arm normally being in the second position thereof when the door is open and being pivoted to the first position thereof by said first actuator arm during the movement of the door to the closed position and being pivoted from the first position thereof to the second position thereof during movement of the door to the open position, and switch means, mounted on said second mounting bracket and actuated responsive to pivoting of said single actuator arm to the first position thereof, for signalling that the door is closed.

13. A door position sensor assembly as claimed in claim 12 wherein said first mounting bracket comprises a first support plate including a mounting flange secured by bolt means to the trailing edge of the door and said second mounting bracket comprising a second support plate including a mounting flange secured by bolt means to said vehicle, the relative positions of said first and second brackets being adjustable by varying the positions at which said bolt means are secured to the door and vehicle, respectively.

14. A door position sensor assembly as claimed in claim 12 further comprising snap-action spring means, located between said single actuator arm and said switch means and pivotable about a pivot pin affixed to said second mounting bracket, for assisting the movement of said actuator arm between said first and second positions thereof and for causing actuation of said switch means responsive to pivoting of said actuator arm to the first position thereof.

15. A door position sensor assembly as claimed in claim 14 wherein said spring means comprises a spring guide including a cylindrical body and a coil spring which surrounds and is supported by the cylinder body of said spring guide.

16. A door position sensor assembly as claimed in claim 15 wherein said spring guide comprises first and second parts, said parts being identical and being slidingly interfit to form said cylindrical body, and wherein each of said parts of said spring guide include end portion which forms an abutment for said coil spring, each said end portion including a groove therein, the groove in the end portion of one of said parts receiving therein said pivot pin and the groove in the end portion of the other of said parts receiving therein a further pivot pin affixed to said single actuator arm.

17. A door position sensor assembly as claimed in claim 12 wherein said actuator means comprises a U-shaped member mounted for rotation about a shaft affixed to said first mounting bracket and including a central outwardly extending tongue member forming said single actuator arm, said further pivot pin being disposed between the side walls of said U-shaped member.

18. A door position sensor assembly as claimed in claim 13 wherein said first actuator member comprises a flange bent out from said first support plate and extending generally perpendicular to the plane of the first support plate and said second actuator member includes a flexible member mounted on a further flange bent out from said first support plate so as to flex in a first direction and to be substantially rigid in a second direction.

* * * * *